United States Patent [19]

Igarashi

[11] Patent Number: 5,017,750

[45] Date of Patent: May 21, 1991

[54] FRAME CONSTRUCTION FOR MICROWAVE OVEN HAVING AN INTEGRALLY FORMED OPEN CHASSIS AND AN INSERTING OPENING

[75] Inventor: Noboru Igarashi, Nara, Japan

[73] Assignee: Sharp Kabushiki Kaisha, Osaka, Japan

[21] Appl. No.: 513,770

[22] Filed: Apr. 24, 1990

[30] Foreign Application Priority Data

Apr. 25, 1989 [JP] Japan ..... 1-49081[U]

[51] Int. Cl.[5] ..... H05B 6/64

[52] U.S. Cl. ..... 219/10.55 R; 219/10.55 E; 29/462; 126/275 R; 312/236

[58] Field of Search ..... 219/10.55 R, 10.55 E, 219/10.55 D, 10.55 F; 126/19 R, 273 R, 21 R, 198, 275 R; 312/236; 29/462, 428, 432

[56] References Cited

U.S. PATENT DOCUMENTS

| | | | |
|---|---|---|---|
| 2,813,185 | 11/1957 | Smith | 219/10.55 F |
| 3,300,615 | 1/1967 | Smith | 219/10.55 F |
| 4,163,141 | 7/1979 | Tanaka et al. | 219/10.55 F |
| 4,165,454 | 8/1979 | Carlsson et al. | 219/10.55 F |
| 4,282,416 | 8/1981 | White | 219/10.55 R |
| 4,597,374 | 7/1986 | Igarashi | 219/10.55 R |
| 4,609,801 | 9/1986 | Spencer et al. | 219/10.55 R |
| 4,680,439 | 7/1987 | Millman | 219/10.55 R |
| 4,788,395 | 11/1988 | Sakoda | 219/10.55 E |

FOREIGN PATENT DOCUMENTS 62-24592 2/1987 Japan .

*Primary Examiner*—Philip H. Leung

[57] ABSTRACT

An improved frame construction for a microwave oven and the like, which is so arranged that, a front panel portion, a bottom plate portion and a rear plate portion are integrally formed into one unit as an open chassis, while an inserting opening is formed in the bottom plate portion of the open chassis in a position under an oven structure of the frame construction for inserting welding jigs or the like through the inserting opening.

14 Claims, 3 Drawing Sheets

FRAME CONSTRUCTION FOR MICROWAVE OVEN HAVING AN INTEGRALLY FORMED OPEN CHASSIS AND AN INSERTING OPENING

BACKGROUND OF THE INVENTION

The present invention generally relates to a heating apparatus and more particularly, to a frame or cabinet construction for a microwave oven having a heating chamber, or for a so-called oven toaster or the like.

FIG. 5 shows a conventional frame construction 1 for a microwave oven, which mainly includes a front panel 2 having a generally rectangular shape, a rear plate 3 disposed at the back thereof, a bottom plate 4 fixed to lower edges of the front panel 2 and of the rear plate 3, a top plate 5 secured to upper portions of the front panel 2 and the rear plate 3 in a parallel relation with the bottom plate 4, and an oven structure 6 having a generally U-shaped cross section and fixed at its front and rear edges to the front panel 2 and to the rear plate 3, respectively, and at its upper edges to the top plate 5. Each of the plate members referred to above has folded portions as welding margins, at respective edge portions thereof to be connected with each other.

For assembling the conventional frame construction 1 in FIG. 5 as described above, the plate members 2,3,5 and 6 other than the above bottom plate 4 are preliminarily combined to each other through fixing by welding or the like, thereby forming an oven (i.e. a heating chamber) surrounded by the respective members. Thereafter, the plate members thus combined are subjected to a painting finish for subsequent drying. Then, the bottom plate 4 is fixed to the lower edges of the front panel 2 and the rear plate 3 by set screws 7, whereby the frame construction 1 for the microwave oven is completed.

However, since the known frame construction 1 is mainly constituted by the five plate members 2,3,4,5, and 6 as described above, press work, for example, in twenty-seven steps has been required for the manufacture of the plate members, and moreover, further processings have also been involved for welding such plate members to each other, and also for fixing the bottom plate 4 by the set screws 7 which must be supplied as separate parts.

Therefore, from the viewpoints of rationalization in processing steps, reduction in the number of required parts, improvement in the physical distribution, etc., it has been required to promote production efficiency.

SUMMARY OF THE INVENTION

Accordingly, an essential object of the present invention is to provide an improved frame construction for a microwave oven and the like, which requires less man-hours for manufacture, and a smaller number of parts involved, and may be readily subjected to physical distribution.

Another object of the present invention is to provide a frame construction of the above described type, which is simple in structure and stable in functioning at high reliability.

In accomplishing these and other objects, according to one preferred embodiment of the present invention, there is provided a frame construction for a microwave oven and the like, which includes a front panel having a generally rectangular configuration at its front face, a rear plate having approximately the same configuration as that of the front panel and disposed at the back thereof, a bottom plate also having generally a rectangular shape and fixed to lower edges of the front panel and said rear plate for connection therebetween, a top plate fixed to upper portions of the respective front panel and rear plate in a parallel relation with the bottom plate, and an oven structure of a generally U-shaped cross section fixed, at its front and rear edges, to the front panel and the rear plate for connection and, at its upper edges, to the top plate to constitute a heating chamber. The front panel, the bottom plate and the rear plate are integrally formed to constitute an open chassis thereby, while the bottom plate is formed with an inserting opening for inserting oven structure joining jigs therethrough.

As to the frame construction for a microwave oven etc. according to the present invention as described above, since the front panel portion, the bottom plate portion and the rear plate portion of the frame construction constituted previously by the front panel, the rear plate, the bottom plate, the top plate and the oven structure are integrally formed as one unit, it becomes possible to reduce the man-hours in the press work steps and simultaneously to reduce the number of the involved parts including the set secrews etc. required for the assembly. Furthermore, since the inserting opening for inserting the oven structure joining jigs therethrough is formed in the bottom plate, such jigs may be guided to the joining portions between the oven structure and the front panel, and also between the oven structure and the rear plate for efficient joining of the oven structure, the front panel, and the rear plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiment thereof with reference to the accompanying drawings which are given by way of illustration only, and thus are not limitative of the present invention, and in which.

DETAILED DESCRIPTION OF THE INVENTION

Figure 2:
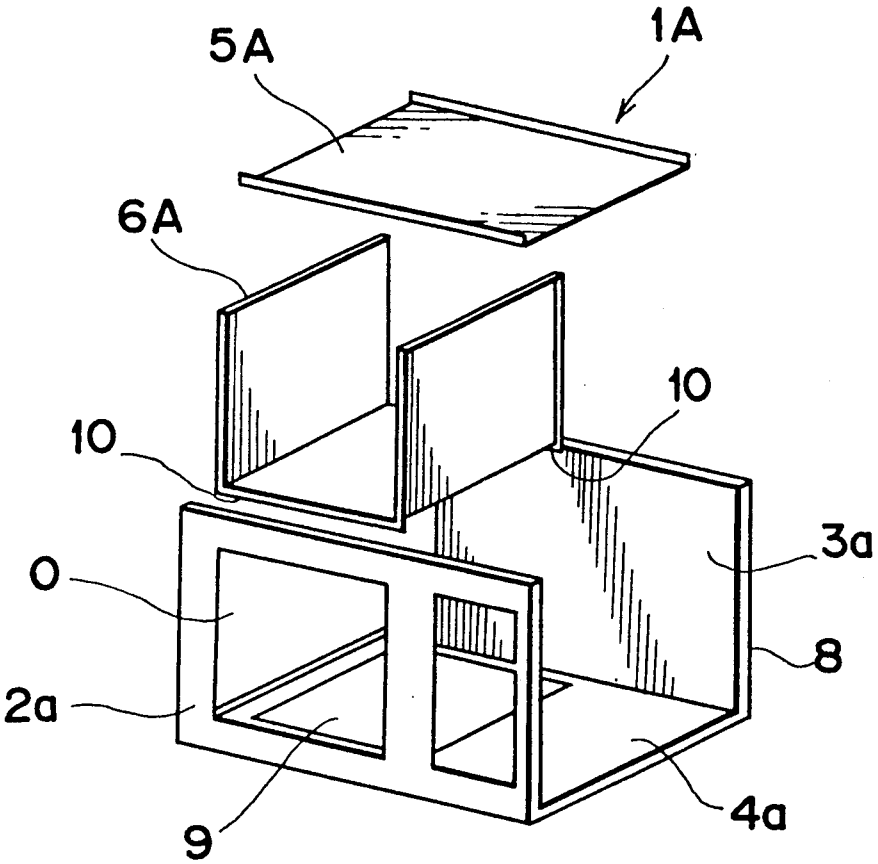
FIG. 2 is an exploded perspective view showing an arrangement of the frame construction of FIG. 1.

Before the description of the present invention proceeds, it is to be noted that like parts are designated by like reference numerals throughout the accompanying drawings.

Figure 1:
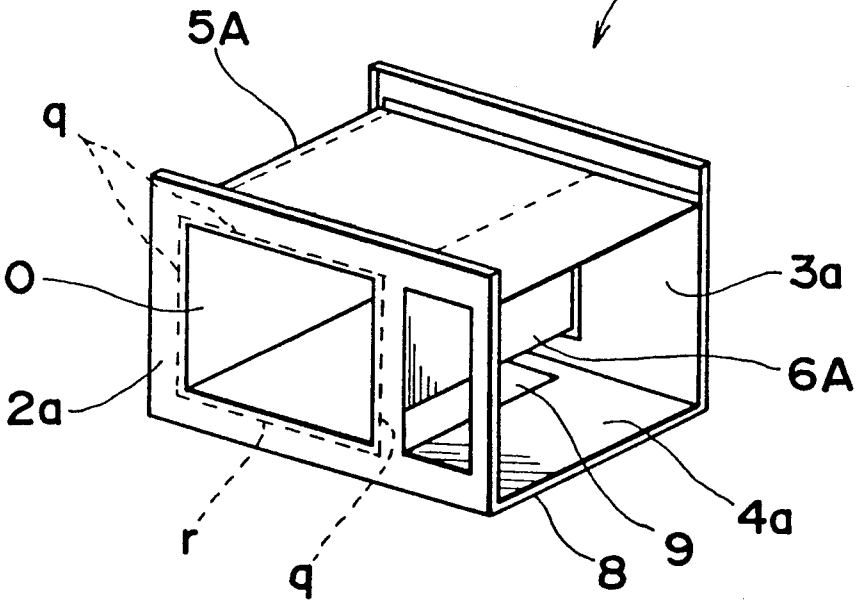
FIG. 1 is a perspective view showing a general appearance of a frame construction for a microwave oven according to one preferred embodiment of the present inventiion.

Referring now to the drawings, there is shown in FIGS. 1 and 2 a frame construction 1A for a microwave oven according to on preferred embodiment of the present invention, in which like parts in the conventional arrangement described earlier with reference to FIG. 5 are designated by like reference numerals for brevity of description.

Figure 5:
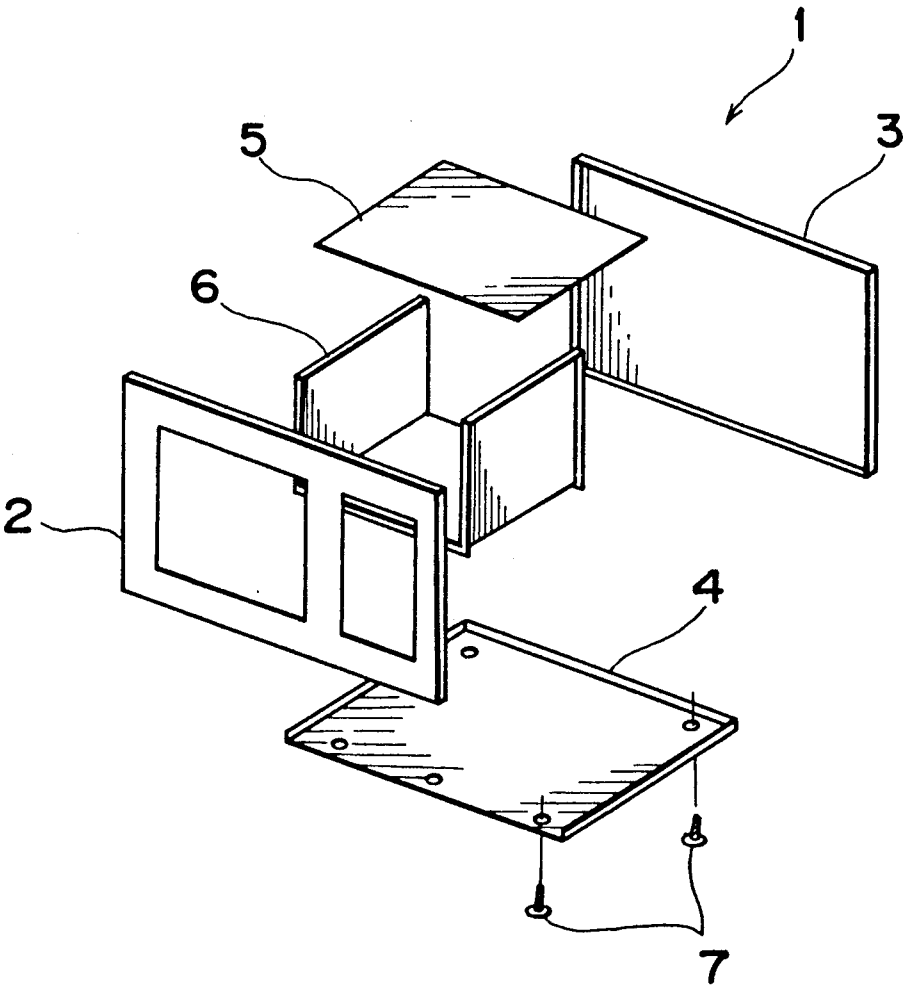
Fig. 5 PRIOR ART
FIG. 5 is an exploded perspective view of a conventional frame construction for a microwave oven (already referred to).

In the embodiment of FIGS. 1 and 2, the frame construction 1A of the present invention differs from the conventional frame construction 1 of FIG. 5 mainly in that a front panel portion 2*a*, a bottom plate portion 4*a*, and a rear plate portion 3*a*, which are equivalent to the front panel 2, the bottom plate 4 and the rear plate 3 shown in FIG. 5, are integrally formed into one unit as an open chassis 8, and also, in that an inserting or means for receiving joining jigs opening 9 is formed in the bottom plate portion 4*a* of the open chassis 8 at a position below the oven structure 6A so that welding jigs 11 (FIG. 3) may be guided into the frame construction 1A therethrough for joining folded portions 10 formed at the front and rear lower edges of the oven structure 6A, with corresponding portions of the front panel portion 2*a* and the rear plate portion 3*a*.

Thus, the oven i.e. the heating chamber for the microwave oven is surrounded by the front panel portion 2*a*, rear plate portion 3*a*, oven structure 6A and top plate 5A, with a square opening 0 defined in the front panel portion 2*a* for permitting a food article to be inserted into or withdrawn from the heating chamber therethrough. More specifically, respective front edge portions of the oven structure 6A and of the top plate 5A are joined with the front panel portion 2*a* along the corresponding edge portions of the square opening 0.

Accordingly, for assembling the frame construction 1A of the present invention arranged as described above, two sides at the upper edges of the oven structure 6A are first joined to the top plate 5A by welding. Then, six sides at the front and rear side edges of the top plate 5A and of the oven structure 6A are respectively joined to the front panel portion 2*a* and the rear plate portion 3*a*. More specifically, at the front edge portions as referred to above, the three sides indicated by dotted lines q in FIG. 1 are joined, and at the rear edge portions, corresponding three sides (not shown) located at the same positions as the three sides at the front edge portions in a horizontal direction are joined in the similar manner. Subsequently, two sides at the front and rear lower edges of the oven structure 6A are joined (In FIG. 1, only one side at the front lower edge of the oven structure 6A is shown by a dotted line r).

Figure 3:
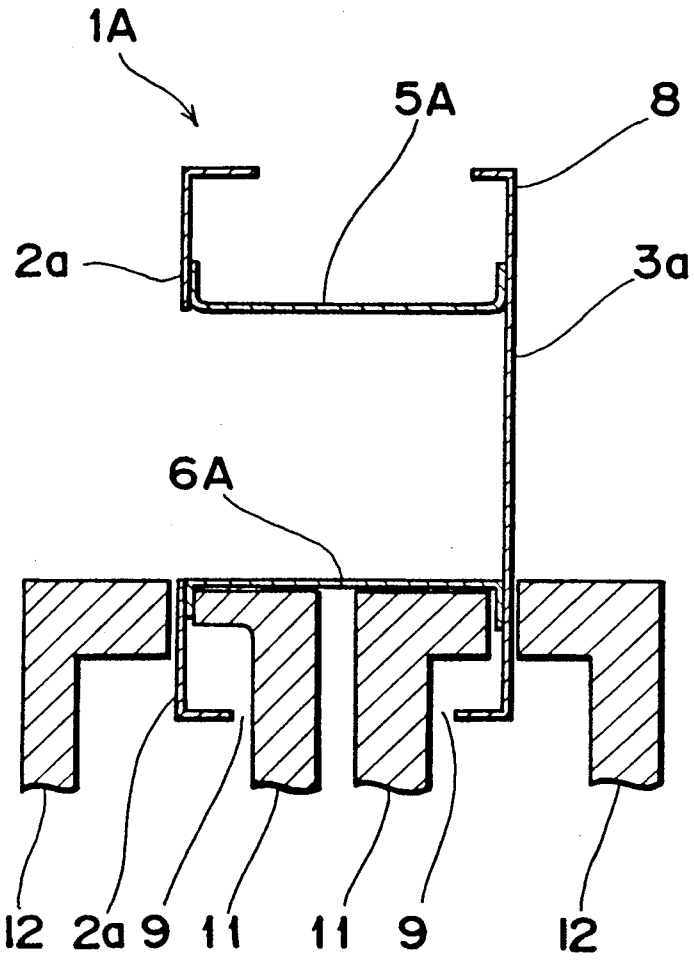
FIG. 3 is a fragmentary cross sectional view showing the state of assembling of the frame construction of FIG. 1 by welding.

In the above mentioned case, since the inserting opening 9 is provided in the bottom plate portion 4*a* of the open chassis 8, the welding jigs 11 may be inserted through the opening 9 as shown in FIG. 3 so as to be led to the front and rear lower edge portions of the oven structure 6A to be joined. Thus, the welding jigs 11, in cooperation with mating welding jigs 12, subject the oven structure 6A and the front panel portion 2*a* and the rear plate portion 3*a* of the open chassis 8 to welding for the joining therebetween. Subsequently, painting is applied to complete the frame structure 1A for the microwave oven.

As described above, in the frame construction 1A according to the present invention, the reduction in the number of parts has been made as compared with the conventional frame construction 1, for example, the reduction of the plate members from five to three pieces, and the elimination of five set screws for the bottom plate, while the man-hours for the press work during manufacture of the plate members has been reduced by approximately 30%, from twenty-five steps to nineteen steps. Furthermore, since the frame construction is completed by the painting after the joining of the plate members, no step to wait for drying of paint is required in the production line, so as to achieve an improvement also in the aspect of physical distribution.

Figure 4:
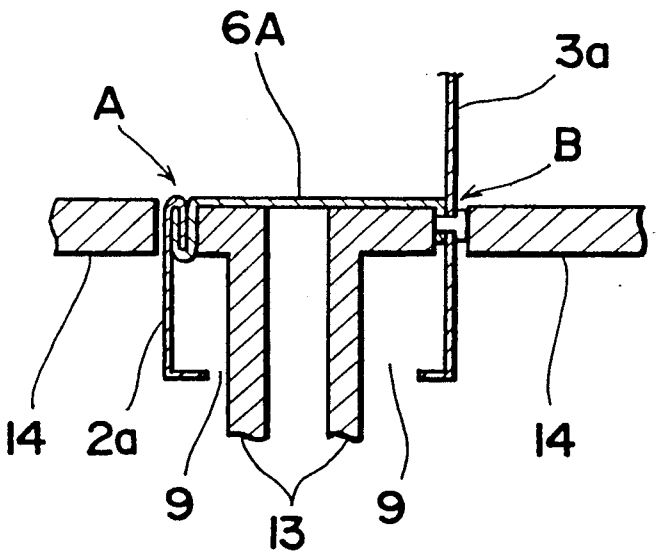
FIG. 4 is a view similar to FIG. 3, which particularly shows the state of assembly of the frame construction of FIG. 1 by caulking etc.

It should be noted here that, in the above embodiment, although the welding jigs 11 and 12 are employed as the joining means, these may be replaced by caulking means 13 and 14 for mechanical joining through modification of the joining portions between the oven structure 6A and the front panel portion 2*a* and between the oven structure 6A and the rear plate portion 3*a*, respectively to a lock seaming portion A and to a riveted portion B as shown in FIG. 4.

As is clear from the foregoing description, according to the present invention, it is so arranged that in the frame construction for a microwave oven and the like, which includes the front panel having a generally rectangular configuration at its front face, the rear plate having approximately the same configuration as that of the front panel and disposed at the back thereof, the bottom plate also having generally a rectangular shape and fixed to lower edges of the front panel and the rear plate for connection therebetween, the top plate fixed to upper portions of the respective front panel and rear plate in a parallel relation with the bottom plate, and the oven structure of a generally U-shaped cross section fixed, at its front and rear edges, to the front panel and the rear plate for connection and, at its upper edges, to the top plate to constitute a heating chamber, the front panel, said bottom plate and the rear plate are integrally formed to constitute the open chassis thereby, while the bottom plate is formed with an inserting opening for inserting oven structure joining jigs therethrough, and therefore, not only the number of parts and man-hours required for the manufacture can be reduced, but improvement on the aspect of physical distribution may also be achieved, with a consequent improvement on the production efficiency for the frame construction.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A frame construction for a microwave oven comprising:

an open chassis of a generally U-shaped cross section, said open chassis having a front portion, a rear portion and a first bottom portion disposed between said front and rear portions, said front portion having an opening defined therein for inserting food material;

an oven structure having a generally U-shaped cross section, said oven structure having a first side portion, a second side portion and a second bottom portion disposed between said first and second side portions, each of said first side portion, said second side portion and said second bottom portion having opposed first and second edges, a first edge of the first and second side portion of the oven structure being fixed to said front portion of said open chassis around the opening in the open chassis, a second edge of the first and second side portion of the oven structure being fixed to the rear portion of said open chassis;

a top plate fixed to said front and rear portions of said open chassis so as to form a heating chamber defined by at least said rear portion of the open chassis, said oven structure and said top plate; and means for receiving joining jigs to attach the oven structure to the open chassis, said means for receiving being located in the first bottom portion of the open chassis, the means for receiving comprising an opening defined in the first bottom portion of the open chassis.

2. The frame construction as recited in claim 1, wherein the opening of the means for receiving generally has a rectangular shape, said joining jigs being one of welding jigs and caulking means for mechanically joining the oven structure to the open chassis, the joining jigs being insertable through the opening in the first bottom portion of the open chassis.

3. The frame construction as recited in claim 1, wherein the front portion, the rear portion and the first bottom portion are integrally formed as a single unit so that said open chassis is of unitary construction thereby avoiding assembly of the open chassis.

4. A method of manufacturing a frame construction for a microwave oven comprising the steps of:

providing an open chassis of a generally U-shaped cross section, said open chassis having a front portion, a rear portion and a first bottom portion disposed between said front and rear portions, said front portion having a first opening defined therein for inserting food material, said first bottom portion having a second opening defined therein;

providing an oven structure having a generally U-shaped cross section, said oven structure having a first side portion, a second side portion and a second bottom portion disposed between the first and second side portions;

joining a top plate to the first and second side portions of the oven structure;

placing the oven structure in the open chassis;

inserting joining jigs through the second opening of the open chassis to hold the oven structure in position relative to the open chassis; and mounting the oven structure to the open chassis after the step of inserting the joining jigs, a heating chamber being formed by at least the rear portion of the open chassis, said oven structure and said top plate.

5. The method of manufacturing a frame construction as recited in claim 4, wherein the step of joining the top plate to the oven structure further comprises the step of welding the top plate at upper edges of the first side portion and the second side portion of the oven structure.

6. The method of manufacturing a frame construction as recited in claim 4, wherein the step of mounting further comprises the steps of:

(a) joining front edges of the first and second side portions of the oven structure and a front edge of the top plate to the front portion of the open chassis;

(b) joining rear edges of the first and second side portions of the oven structure and a rear edge of the top plate to the rear portion of the open chassis; and (c) joining a front edge of the second bottom portion of the oven structure to the front portion of the open chassis, and joining a rear edge of the second bottom portion of the oven structure to the rear portion of the open chassis.

7. The method of manufacturing a frame construction as recited in claim 6, wherein the joining steps (a) and (b) are carried out before the joining step (c).

8. The method of manufacturing a frame construction as recited in claim 6, wherein the steps of joining (a, b and c) further comprise the step of welding the oven structure to the open chassis.

9. The method of manufacturing a frame construction as recited in claim 8, further comprising the step of painting the frame structure after the step of welding.

10. The method of manufacturing a frame construction as recited in claim 4, wherein the step of mounting further comprises the step of welding the oven structure to the open chassis.

11. The method of manufacturing a frame construction as recited in claim 10, further comprising the step of painting the frame structure after the step of welding.

12. The method of manufacturing a frame construction as recited in claim 4, wherein the step of mounting further comprises caulking at least a portion of the oven structure to the open chassis.

13. The method of manufacturing a frame construction as recited in claim 12, wherein the step of caulking comprises caulking the rear portion of the open chassis to the second bottom portion of the oven structure and caulking the front portion of the open chassis to the second bottom portion of the oven structure to form a lock seaming portion.

14. The method of manufacturing a frame construction as recited in claim 12, wherein the step of caulking further comprises the step of riveting at least the rear portion of the open chassis to the second bottom portion of the oven structure.

* * * * *